US012264451B2

(12) United States Patent
Suzuki et al.

(10) Patent No.: US 12,264,451 B2
(45) Date of Patent: Apr. 1, 2025

(54) HYDRAULIC EXCAVATOR

(71) Applicant: HITACHI CONSTRUCTION MACHINERY CO., LTD., Tokyo (JP)

(72) Inventors: Yusuke Suzuki, Ibaraki (JP); Hiroaki Tanaka, Ibaraki (JP); Hisami Nakano, Ibaraki (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 430 days.

(21) Appl. No.: 17/801,809

(22) PCT Filed: Jan. 27, 2021

(86) PCT No.: PCT/JP2021/002885
§ 371 (c)(1),
(2) Date: Aug. 24, 2022

(87) PCT Pub. No.: WO2022/162795
PCT Pub. Date: Aug. 4, 2022

(65) Prior Publication Data

US 2023/0091185 A1 Mar. 23, 2023

(51) Int. Cl.
*E02F 3/32* (2006.01)
*E02F 3/43* (2006.01)
(Continued)

(52) U.S. Cl.
CPC ..... *E02F 3/435* (2013.01); *E02F 3/32* (2013.01); *E02F 9/2203* (2013.01); *E02F 9/262* (2013.01); *E02F 9/2221* (2013.01); *E02F 9/2285* (2013.01)

(58) Field of Classification Search
CPC . E02F 3/435; E02F 3/32; E02F 9/2203; E02F 9/262; E02F 9/2221; E02F 9/2285;
(Continued)

(56) References Cited

U.S. PATENT DOCUMENTS

2008/0127529 A1* 6/2008 Stanek ..... E02F 3/435 37/348
2015/0284930 A1 10/2015 Tsukamoto
(Continued)

FOREIGN PATENT DOCUMENTS

JP 04366236 A 12/1992
JP 2014122510 A 7/2014
(Continued)

OTHER PUBLICATIONS

International Search Report of PCT/JP2021/002885 dated Apr. 6, 2021.

*Primary Examiner* — Rachid Bendidi
*Assistant Examiner* — Hossam M Abd El Latif
(74) *Attorney, Agent, or Firm* — MATTINGLY & MALUR, PC

(57) ABSTRACT

A hydraulic excavator includes a traveling body, a slewing body, a working front having a boom, an arm, and a bucket, an operation amount detector, a posture detector, a load detector, a drive controller, and a drive unit. The drive controller calculates a target operation speed of the actuator based on the operation amount, the posture of the working front, and the target surface distance so that the bucket excavates along the construction target surface, and determines soil hardness of a place to be excavated based on a result detected by the load detector, corrects the target operation speed based on the soil hardness, and generates a motion command value. The drive controller determines a target jack-up speed when the hydraulic excavator jacks up based on the target surface distance, and corrects the target operation speed based on the determined target jack-up speed.

8 Claims, 15 Drawing Sheets

(51) Int. Cl.
*E02F 9/12* (2006.01)
*E02F 9/22* (2006.01)
*E02F 9/26* (2006.01)

(58) Field of Classification Search
CPC ..... E02F 9/123; E02F 9/265; E02F 9/2246; E02F 9/2271; B60Y 2200/412
USPC ..... 701/50
See application file for complete search history.

(56) References Cited

U.S. PATENT DOCUMENTS

| | | | | |
|---|---|---|---|---|
| 2017/0089033 | A1 | 3/2017 | Matsuyama et al. | |
| 2018/0073219 | A1 | 3/2018 | Park et al. | |
| 2021/0032841 | A1* | 2/2021 | Ishihara | E02F 3/844 |
| 2021/0148082 | A1 | 5/2021 | Suzuki et al. | |
| 2022/0243422 | A1* | 8/2022 | Kassen | E02F 9/262 |
| 2022/0364327 | A1* | 11/2022 | Ahn | F15B 21/14 |
| 2022/0403617 | A1* | 12/2022 | Matsuyama | E02F 3/3677 |

FOREIGN PATENT DOCUMENTS

| | | | |
|---|---|---|---|
| JP | 5947477 | B1 | 7/2016 |
| JP | 2018080510 | A | 5/2018 |
| WO | 2020049623 | A1 | 3/2020 |

* cited by examiner

HYDRAULIC EXCAVATOR

TECHNICAL FIELD

The present invention relates to hydraulic excavators used for various works such as road construction, construction work, civil engineering work, and dredging work.

BACKGROUND ART

Known hydraulic excavators, which are used for road construction, construction work, civil engineering work, dredging work, etc., include a stewing body that is slewably mounted to the upper part of the traveling body traveling by the power system, and a multi-joint working front attached to the slewing body to be vertically swingable. Various components of the working front are driven by cylinders. The working front includes a boom, an arm, and a bucket. Some hydraulic excavators of this type have a machine control function of setting an operable area, within which the working front semi-automatically operates. During the machine controlling, the operator configures a construction target surface. For the boom operation, the function limits the operating speed of the boom for deceleration and stopping in accordance with the distance between the construction target surface and the bucket so as to avoid the bucket from entering the construction target surface. For the arm operation, the function allows the boom or the bucket to operate semi-automatically along the construction target surface.

When excavating hard soil with a hydraulic excavator, the operator jacks up the excavator (details are described below) so as to raise the front of the traveling body with the rear of the traveling body and the working front serving as the fulcrum. The excavation force of the working front is at its maximum when the hydraulic excavator is jacked up. The operator therefore excavates the hard soil efficiently and precisely by fine-tuning the operation amount of the control lever through the comprehensive judgment of: the hardness of the soil to be excavated; the distance between the target construction surface and the bucket; and the state of jack-up of the hydraulic excavator.

Patent Literature 1 discloses the technique for correcting the boom operating speed. To this end, the technique integrates the distance between the target surface of construction and the bucket over time for accurate excavation using machine control. When the soil to be excavated is hard and the construction target surface and the bucket are continuously kept apart from each other, this technique corrects the operating speed of the boom so as to bring the bucket closer to the construction target surface. If the excavation reaction force acting on the bucket exceeds the maximum excavation force of the hydraulic excavator, the hydraulic excavator jacks up. That is, if the construction target surface and the bucket are continuously kept apart from each other, the technique of Patent Literature 1 corrects the operating speed of the boom, and the hydraulic excavator is gradually jacked up.

CITATION LIST

Patent Literature

Patent Literature 1: JP 5947477 B

SUMMARY OF INVENTION

Technical Problem

The machine-controlled excavation work requires quick jack-up of the hydraulic excavator like typical manual excavation work by operators from the viewpoint of operability and workability. Further, as described above, the machine-controlled excavation work requires accurate control of the working front so that the bucket does not enter the construction target surface. Therefore, the technique is required to control the jack-up speed of the hydraulic excavator for better operability and workability of the operator while maintaining the accuracy of excavation.

According to the technique described in Patent Literature 1, however, the hydraulic excavator may be jacked up slowly, because the correction amount of the boom operating speed increases with the length of time that the construction target surface and the bucket are kept apart from each other. This means that the hydraulic excavator will fail to reach a predetermined jack-up speed unless the construction target surface and the bucket are kept apart from each other for a certain period of time. The hydraulic excavator therefore will fail to quickly jack up in the vicinity of the construction target surface.

In view of the above problems, the present invention aims to provide a hydraulic excavator capable of quickly jacking up in the vicinity of a construction target surface.

Solution to Problem

A hydraulic excavator according to the present invention includes: a traveling body that travels; a stewing body mounted to the traveling body to be slewable; a working front mounted to the slewing body to be swingable, the working front having a boom, an arm, and a bucket; an actuator configured to drive the boom, the arm, and the bucket; an operation amount detector configured to detect an operation amount of an operation device to operate the actuator; a posture detector configured to detect a posture of the working front and a posture of the slewing body; a target surface management unit configured to set a construction target surface and calculate a target surface distance that is a distance between the set construction target surface and the bucket; a drive controller configured to calculate a target operation speed of the actuator based on the operation amount, the posture of the working front, and the target surface distance so that the bucket excavates along the construction target surface, and generate a motion command value to the actuator; and a drive unit configured to drive the actuator in accordance with the motion command value. The drive controller is configured to determine a target jack-up speed when the hydraulic excavator jacks up the hydraulic excavator based on the target surface distance, and correct the target operation speed based on the determined target jack-up speed.

The hydraulic excavator according to the present invention includes the drive controller that determines a target jack-up speed when the hydraulic excavator jacks up the hydraulic excavator based on the target surface distance, and corrects the target operation speed based on the determined target jack-up speed. This allows the hydraulic excavator to quickly jack up in the vicinity of a construction target surface.

Advantageous Effects of Invention

The present invention allows the hydraulic excavator to quickly jack up in the vicinity of a construction target surface.

DESCRIPTION OF EMBODIMENTS

The following describes a hydraulic excavator that is one embodiment according to the present invention, with reference to the attached drawings. In the following descriptions, upper, lower, left, right, front and rear directions and positions are based on the typical operating state of the hydraulic excavator, that is, when the traveling body of the hydraulic excavator comes in contact with the ground.

Figure 1:
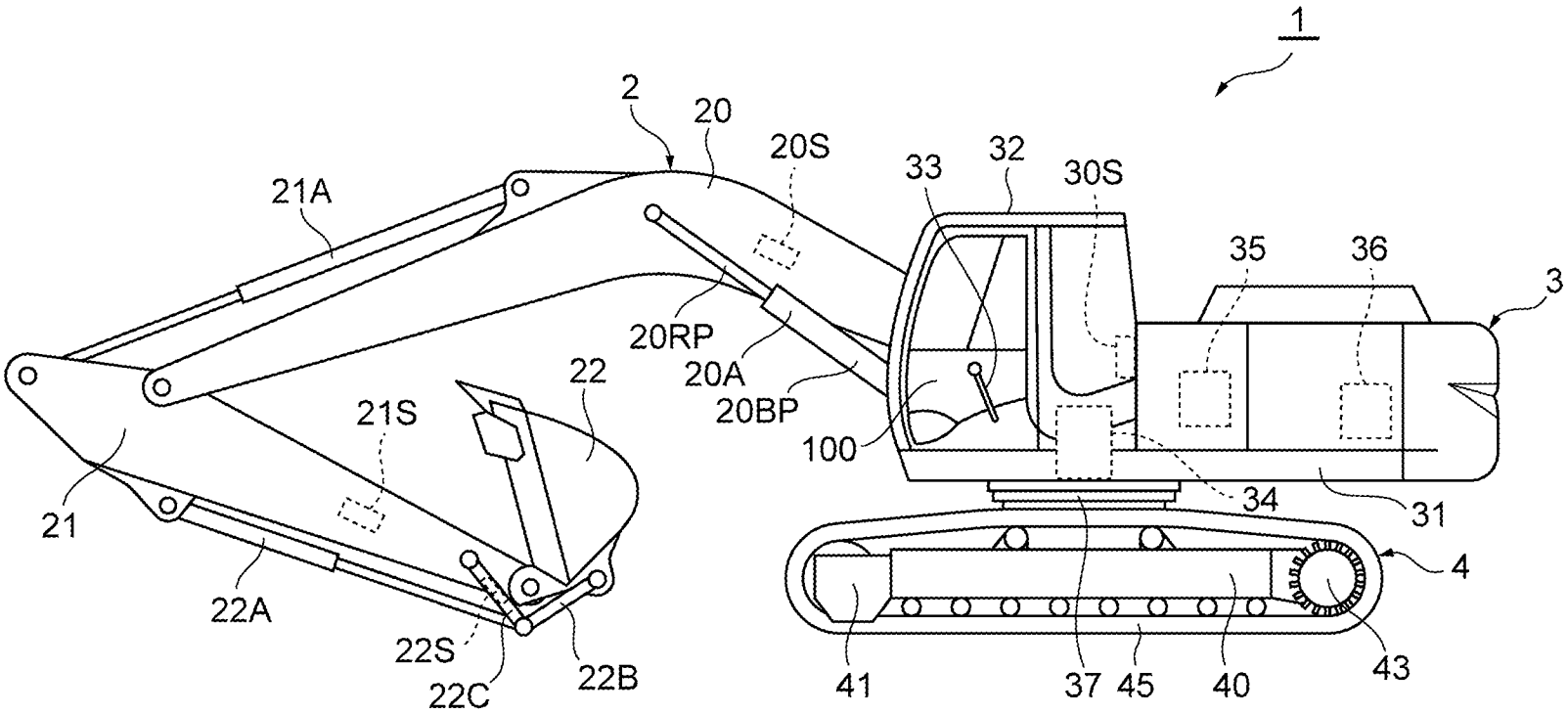
FIG. 1 is a side view showing a hydraulic excavator according to one embodiment.

As shown in FIG. 1, a hydraulic excavator 1 according to the present embodiment includes a traveling body 4 that travels by a power system, a stewing body 3 mounted to the traveling body 4 so as to be slewable left and right, and a working front 2 attached to the slewing body 3. In one example, the traveling body 4 and the stewing body 3 are each driven by a hydraulic actuator.

Working Front

The working front 2 is configured to swing vertically relative to the stewing body 3. This working front 2 includes a boom 20 connected to the stewing body 3, an arm 21 connected to the boom 20, a bucket 22 connected to the arm 21, a boom cylinder 20A having one end connected to the boom 20 and the other end connected to the stewing body 3, an arm cylinder 21A having one end connected to the arm 21 and the other end connected to the boom 20, a first link 22B, a second link 22C, and a bucket cylinder 22A having one end connected to second link 22C and the other end connected to the arm 21. Each of these components is configured to swing vertically around the connecting portion.

The boom cylinder 20A, arm cylinder 21A, and bucket cylinder 22A correspond to an "actuator" recited in the claims. For example, they each include a hydraulic actuator that is capable of driving the boom 20, arm 21, or bucket 22 by their expansion and contraction. The bucket 22 may be replaced with a grapple, breaker, ripper, magnet, or any other working tools not shown.

The boom 20 has a built-in boom inertial measurement unit (IMU) sensor 20S that detects the posture of the boom 20, and the arm 21 has a built-in arm IMU sensor 21S that detects the posture of the arm 21. The second link 22C has a built-in bucket sensor 22S that detects the posture of the bucket 22. These boom IMU sensor 20S, arm IMU sensor 21S, and bucket IMU sensor 22S each include an angular rate sensor and an acceleration sensor.

The boom cylinder 20A also has a cylinder pressure sensor attached to it, and the cylinder pressure sensor includes a boom bottom pressure sensor 20BP and a boom rod pressure sensor 20RP.

Slewing Body

The stewing body 3 includes a stewing body IMU sensor 30S, a main frame 31, a driver's cab 32, an operation amount detector 33, a drive controller 34, a drive unit 35, a prime mover 36, a stewing angle sensor 37, and a target surface management unit 100. The main frame 31 is the base portion of the stewing body 3 and is slewably mounted to the traveling body 4. The stewing body IMU sensor 30S, the driver's cab 32, the drive controller 34, the drive unit 35, and the prime mover 36 are located above the main frame 31. The stewing body MU sensor 30S includes an angular rate sensor and an acceleration sensor, and detects the inclination of the stewing body 3 relative to the ground. In one example, the stewing angle sensor 37 is a potentiometer, and is attached to be able to detect the relative angle between the stewing body 3 and the traveling body 4.

The operation amount detector 33 is located inside the driver's cab 32, and includes two operation levers (operation device) 33A and 33B and an operation input amount sensor 33C (see FIG. 2) that detects the tilting amount of these levers. The operation input amount sensor 33C is configured to detect the tilting amount of the operation levers 33A and 33B by the operator the operation amount R, of the operation levers), and thus convert the requested speed that is requested from the operator for the working front 2 into electrical signals. The operation levers 33A and 33B may be hydraulically piloted.

The drive unit 35 includes an electromagnetic control valve 35A and a directional switching valve 35B (see FIG. 2), and drives these electromagnetic control valve 35A and directional switching valve 35B in accordance with a control command value instructed from the drive controller 34, thus activating the boom cylinder 20A, arm cylinder 21A, and bucket cylinder 22A that are hydraulic actuators.

The prime mover 36 includes an engine 36A and a hydraulic pump 36B (see FIG. 2), and generates hydraulic pressure necessary to power the operation of the hydraulic excavator 1. The target surface management unit 100 includes a target surface management controller.

Traveling Body

The traveling body 4 includes a track frame 40, a front idler 41, a sprocket 43, and a crawler 45. The front idler 41 and the sprocket 43 are placed on the track frame 40, and the crawler 45 goes around the track frame 40 via those components. The operator operates the operation levers 33A and 33B to adjust the rotation speed of the sprocket 43, and drive the hydraulic excavator 1 via the crawler 45. The traveling body 4 is not limited to the structure including the crawler 45, and may include traveling wheels and legs.

Figure 2:
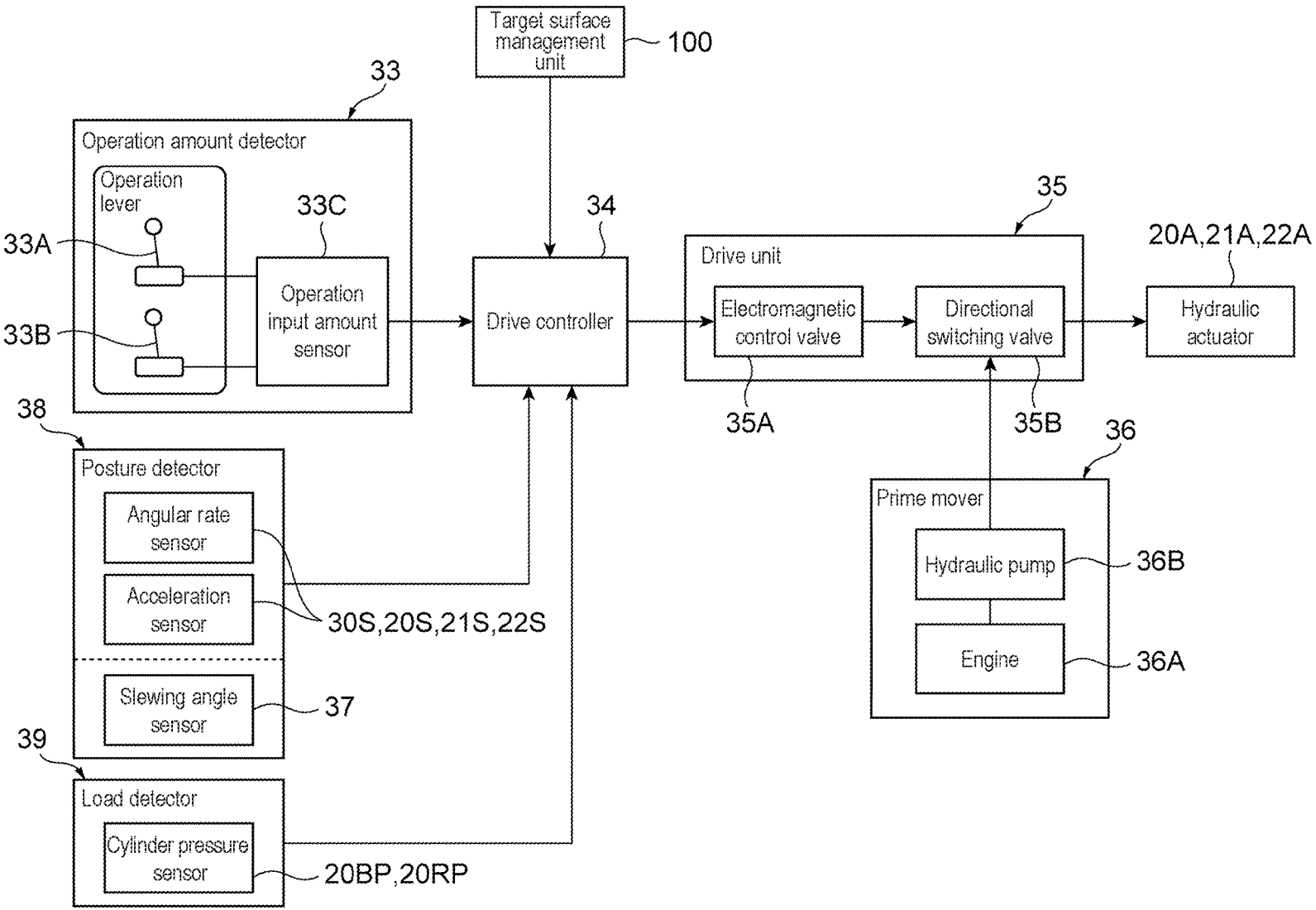
FIG. 2 shows the configuration of a control system of the hydraulic excavator.

Referring to FIG. 2, the following describes a control system of the hydraulic excavator 1. The control system of the hydraulic excavator 1 mainly includes the operation amount detector 33, a posture detector 38, a load detector 39, the target surface management unit 100, the drive unit 35, the drive controller 34, and the prime mover 36. The operation amount detector 33, the posture detector 38, the load detector 39, and the target surface management unit 100 are each electrically connected with the drive controller 34.

Operation Amount Detector

Hydraulic excavators are typically configured to increase the operating speed of each cylinder with the tilting amount of the corresponding lever (i.e., the operation amount R of the operation lever). Thus, the operator changes the tilting amount of the operation lever to change the operating speed of the corresponding cylinder and thus activate the hydraulic excavator. As described above, the operation amount detector 33 includes the operation levers 33A, 33B and the operation input amount sensor 33C. The operation input amount sensor 33C has a boom operation input amount sensor, an arm operation input amount sensor, and a bucket operation input amount sensor that are for electrical detection of the operation amount R of the operation levers 33A and 33B. This enables detection of the operator's requested speeds for the boom cylinder 20A, arm cylinder 21A, and bucket cylinder 22A. The sensors that detect the operation amount R are not limited to the one that directly detects the tilting amount of the operation levers, and may be a method that detects the operated pilot pressure.

Posture Detector

The posture detector 38 includes the slewing body IMU sensor 30S, the boom IMU sensor 20S, the arm IMU sensor 21S, the bucket IMU sensor 22S, and the stewing angle sensor 37. These IMU sensors each have an angular rate sensor and an acceleration sensor, and thus obtain signals of angular rate and acceleration at their respective sensor positions. The boom 20, the arm 21, the bucket 22, the boom cylinder 20A, the arm cylinder 21A, the bucket cylinder 22A, the first link 22B, the second link 22C, and the slewing body 3 are each mounted to be swingable. The posture detector 38 therefore detects the posture of these boom 20, arm 21, bucket 22, and slewing body 3 from their mechanical link relationship.

The method for detecting the posture shown here is an example, which may include direct measurement of the relative angle of various parts of the working front 2, and the method of detecting the strokes of the boom cylinder 20A, arm cylinder 21A, and bucket cylinder 22A to detect the posture of various parts of the hydraulic excavator 1. As described above, the slewing angle sensor 37 is a potentiometer, which detects the relative angle of the traveling body 4 relative to the slewing body 3. The slewing angle sensor 37 may be any measurement device other than the potentiometer, as long as it can measure the slewing angle.

Load Detector

The load detector 39 includes the boom bottom pressure sensor 20BP and the boom rod pressure sensor 20RP constituting the cylinder pressure sensor. The load detector 39 detects the load on the boom cylinder 20A (i.e., the pressure applied to the boom cylinder 20A) via these sensors. The method for detecting the load is not limited to this, and load cells may be used, for example.

Target Surface Management Unit

Figure 4:
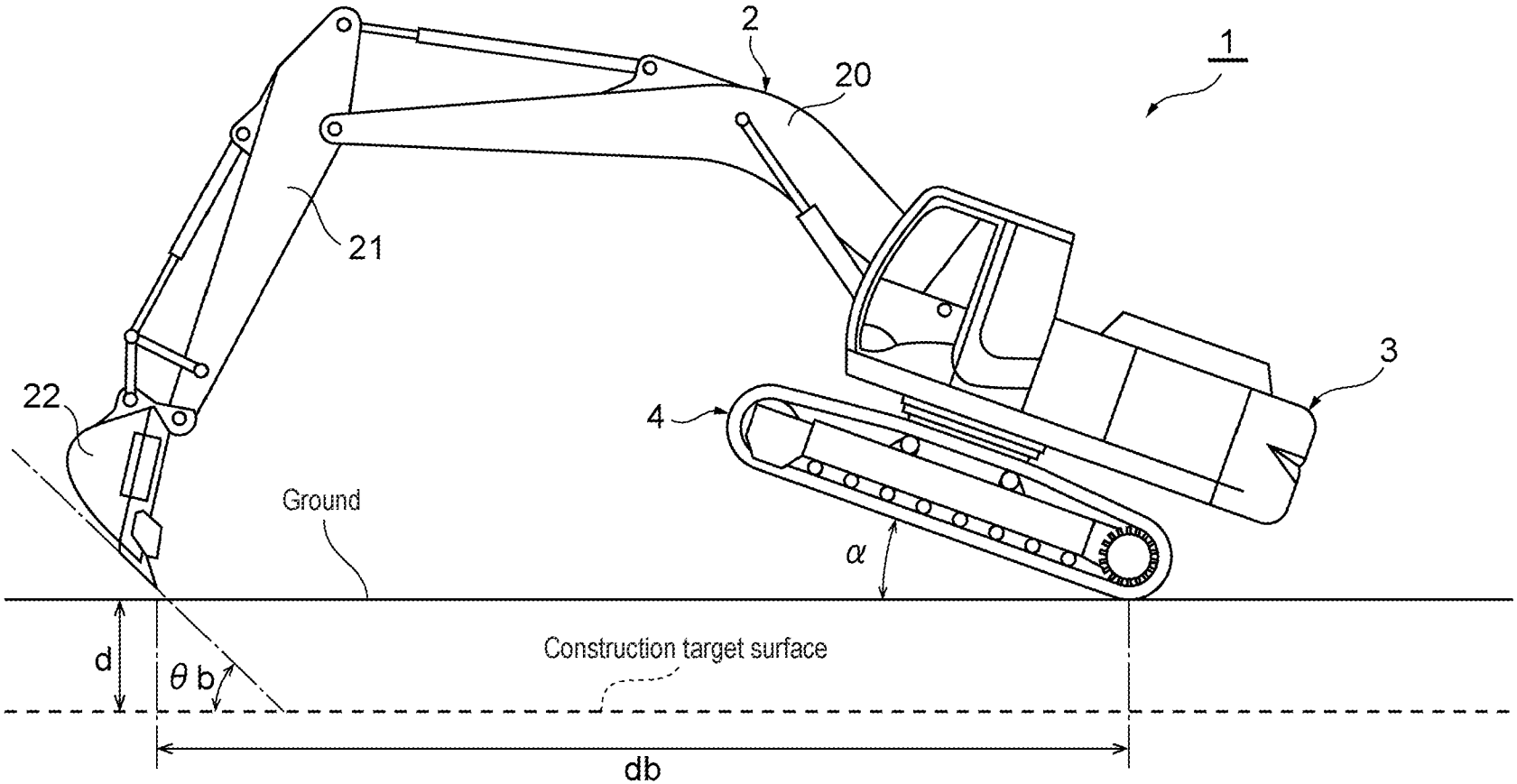
FIG. 4 is a side view showing the hydraulic excavator that is jacked up according to one embodiment.

As shown in FIG. 4, the target surface management unit 100 sets a construction target surface, and also calculates the distance between the set construction target surface and the bucket 22 (hereinafter referred to as a target surface distance d) based on the traveling body inclination angle θp calculated by an inclination angle calculation unit 820 (described later) and the posture of the working front 2 detected by a front posture detector 830 (described later), and outputs the calculated result to the drive controller 34. In the present embodiment, the target surface management unit 100 calculates the shortest distance between the set construction target surface and the bucket 22, and outputs the calculated result to the drive controller 34. This target surface management unit 100 also calculates the angle θb between the bottom surface of the bucket 22 and the construction target surface (hereinafter referred to as a bucket-to-target surface angle θb) based on the traveling body inclination angle θp calculated by the inclination angle calculation unit 820 and the posture of the working front 2 detected by the front posture detector 830. The construction target surface may be directly input and set by the operator, or may be set by inputting a design drawing or the like created in advance.

Drive Unit

As described above, the drive unit 35 includes the electromagnetic control valve 35A and the directional switching valve 35B, and controls the amount of pressure oil to be supplied to the hydraulic actuators that drive various parts of the hydraulic excavator 1 in accordance with the control command values instructed from the drive controller 34. More specifically, the control current output from the drive controller 34 is converted to pilot pressure by the electromagnetic control valve 35A, so that the pilot pressure drives the spooling of the directional switching valve 35B. The hydraulic oil whose flow rate is adjusted by the directional switch valve 35B is then supplied to the hydraulic actuators that drive various parts of the hydraulic excavator 1 to drive various movable parts. For example, the drive unit 35 adjusts the flow rate and direction of hydraulic oil supplied from prime mover 36 to drive the hydraulic actuators that drive the boom cylinder 20A, the arm cylinder 21A, the bucket cylinder 22A, the stewing body 3, and the traveling body 4.

Prime Mover

As described above, the prime mover 36 includes the engine 36A and the hydraulic pump 36B, and generates pressure oil necessary to drive the hydraulic actuators that drive the boom cylinder 20A, the arm cylinder 21A, the bucket cylinder 22A, the stewing body 3, and the traveling body 4. The prime mover 36 is not limited to this configuration, and other power sources such as an electric pump may be used.

Drive Controller

The drive controller 34 includes a controller for drive control, and processes signals from the operation amount detector 33, the posture detector 38, the load detector 39, and the target surface management unit 100 and outputs operation commands to the drive unit 35.

Figure 3:
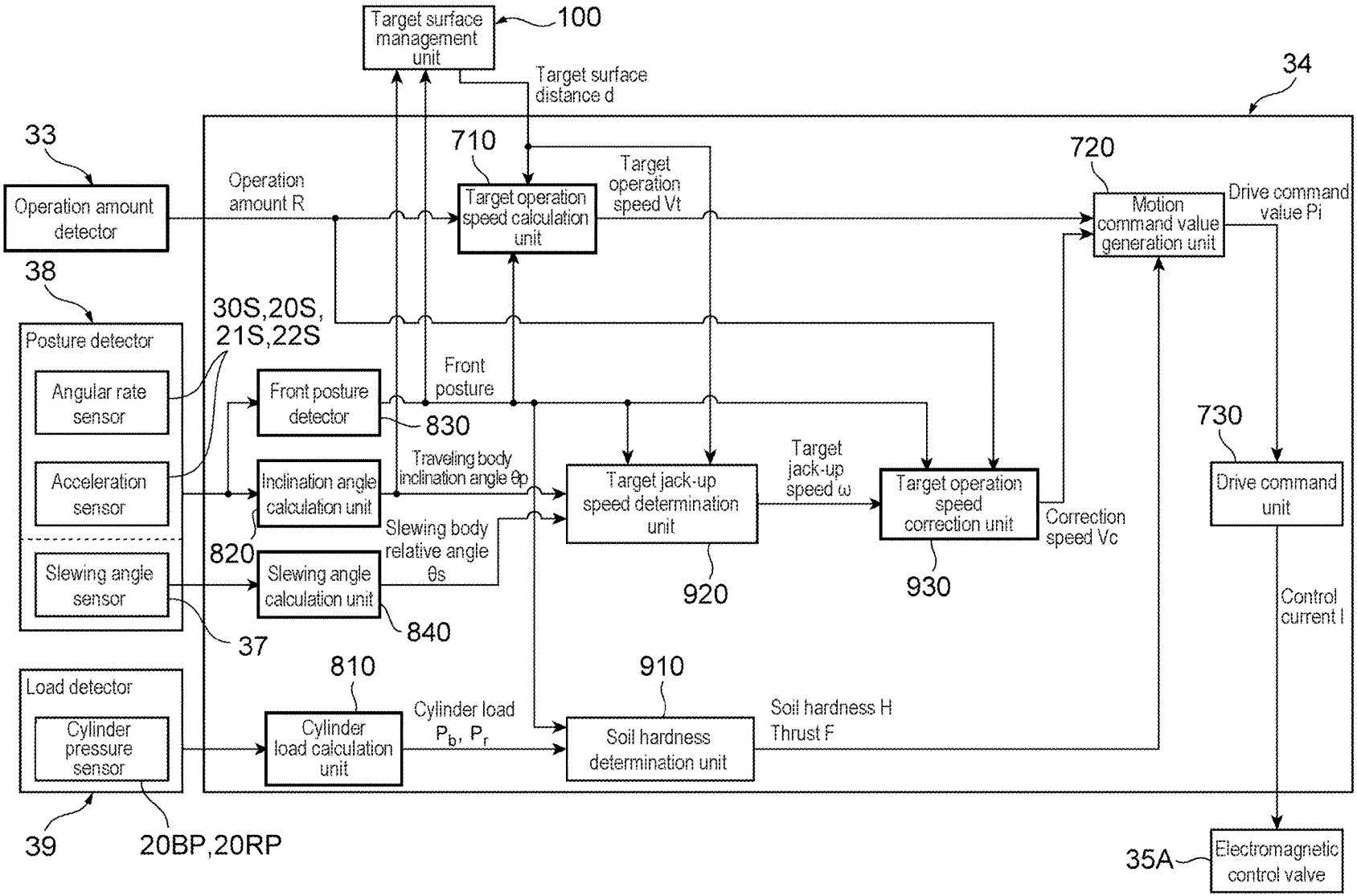
FIG. 3 shows the configuration of a drive controller of the hydraulic excavator.

FIG. 3 shows the configuration of the drive controller of the hydraulic excavator. As shown in FIG. 3, the drive controller 34 mainly includes a target operation speed calculation unit 710, a motion command value generation unit 720, a drive command unit 730, a cylinder load calculation unit 810, a slewing angle calculation unit 840, an inclination angle calculation unit 820, the front posture detector 830, a soil hardness determination unit 910, a target jack-up speed determination unit 920, and a target operation speed correction unit 930.

The target operation speed calculation unit 710 calculates the target operation speed Vt of at least one of the boom cylinder 20A, the arm cylinder 21A, and the bucket cylinder 22A so that the bucket 22 moves along the construction target surface. This calculation is made based on the operation amount R of the operation levers 33A and 33B detected by the operation input amount sensor 33C, the target surface distance d calculated by the target surface management unit 100, and the posture of the working front 2 detected by the front posture detector 830.

For a specific calculation method of the target operating speed Vt, a well-known method can be used. For example, as described in JP 2018-080510 A, the target operation speed calculation unit 710 determines the moving direction and speed of the end of the bucket claw so that the end of the bucket claw moves along the construction target surface, and calculates and determines the target operating speed of the boom, arm and bucket so as to achieve the determined speed.

The motion command value generation unit 720 generates a drive command value Pi required to operate the cylinders using predetermined table data, based on the target operation speed Vt calculated by the target operation speed calculation unit 710. The motion command value generation unit 720 also generates a drive command value Pi based on the correction speed Vc output from the target motion speed correction unit 930. This drive command value corresponds to a "motion command value" recited in the claims.

The drive command unit 730 generates control current I required for driving the electromagnetic control valve 35A based on the drive command value Pi generated by the motion command value generation unit 720.

The cylinder load calculation unit 810 calculates the cylinder load (i.e., boom bottom side load $P_b$ and boom rod side load $P_r$) based on the detection results of the boom bottom pressure sensor 20BP and the boom rod pressure sensor 20RP attached to the boom cylinder 20A.

The slewing angle calculation unit 840 calculates the relative angle between the slewing body 3 and the traveling body 4 (hereinafter referred to as stewing body relative angle θs) based on the signal detected by the slewing angle sensor 37. The stewing body relative angle θs is based on the travelling direction of the traveling body 4. In FIGS. 1 and 4, the traveling body 4 travels leftward.

The inclination angle calculation unit 820 calculates the inclination angle of the slewing body 3 based on the acceleration signal and the angular velocity signal obtained from the slewing body sensor 30S attached to the slewing body 3. In the present embodiment, the slewing body 3 and the traveling body 4 have the same inclination angle, so that the inclination angle of the slewing body 3 obtained by calculation is used as the inclination angle of the traveling body 4 (hereinafter, referred to as traveling body inclination angle θp).

The front posture detector 830 detects the posture of each of the boom 20, arm 21, and bucket 22 based on the acceleration signal and the angular velocity signal obtained from the boom IMU sensor 20S, the arm MU sensor 21S, and the bucket IMU sensor 22S.

The soil hardness determination unit 910 determines the soil hardness of the place where the working front 2 excavates. To determine the soil hardness, methods include a method using the soil hardness H and a method using the thrust F of the boom cylinder 20A. In the method using the soil hardness H, the soil hardness determination unit 910 first calculates the hardness of soil (soil hardness H) where the working front 2 is excavating, based on the result from the front posture detector 830 and the cylinder load calculation unit 810, that is, the front posture and the boom cylinder load. Next, the soil hardness determination unit 910 determines the soil hardness by comparing the calculated soil hardness H with a predetermined hardness threshold. For example, if the calculated soil hardness H is greater than the hardness threshold, the soil hardness determination unit 910 determines that the soil is hard. In one example, the hardness threshold is determined based on empirical values of hardness for various soils.

In the method using the thrust F of the boom cylinder 20A, the soil hardness determination unit 910 first obtains the thrust F of the boom cylinder 20A based on the following equation (1). In equation (1), $S_b$ denotes the boom bottom side pressure receiving area, $P_b$ denotes the boom bottom side load, $S_r$ denotes the boom rod side pressure receiving area, and $P_r$ denotes the boom rod side load.

$$F=S_b\times P_b-S_r\times P_r \tag{1}$$

Next, the soil hardness determination unit 910 determines a threshold according to the posture of the working front 2, and compares the thrust F of the boom cylinder 20A obtained by the equation (1) with the threshold to determine the soil hardness. For example, if the thrust of the boom cylinder 20A is greater than the threshold, the solid hardness determination unit 910 determines that the soil is hard. The threshold in this case may be determined by a value calculated from the weight of the working front 2, or may be determined by using experimental values when the hydraulic excavator 1 is actually jacked up.

The target jack-up speed determination unit 920 calculates and determines target jack-up speed ω when the traveling body 4 is jacked up, based on the target surface distance d and bucket-to-target surface angle θb calculated by the target surface management unit 100, the bucket-to-traveling body distance db, the traveling body inclination angle θp calculated by the inclination angle calculation unit 820, and the slewing body relative angle θs calculated by the slewing angle calculation unit 840. As shown in FIG. 4, the target surface distance d is the shortest distance between the construction target surface and the bucket 22, and the bucket-to-target surface angle θb is the angle between the bottom surface of the bucket 22 and the construction target surface. The bucket-to-traveling body distance db is the distance between the bucket 22 and the traveling body 4 in the traveling direction of the hydraulic excavator 1, and is calculated by the target jack-up speed determination unit 920.

Jack Up

Referring to FIG. 4, the following describes jack-up of the hydraulic excavator 1. As shown in FIG. 4, jack-up refers to a state in which the rear portion of the traveling body 4 and the bucket 22 are in contact with the ground, and the front portion of the traveling body 4 is floating in the air. Then, the angle between the bottom surface of the traveling body 4 and the ground is called jack-up angle α. When the jack-up angle α is zero, the entire bottom surface of the traveling body 4 is grounded. The jack-up speed is a change of the jack-up angle α over time, and indicates the angular velocity of the traveling body 4 centered on the contact point between the traveling body 4 and the ground.

Note that the stewing body 3 is slewable relative to the traveling body 4. Thus, the directions of the stewing body 3 and the traveling body 4 may be in the opposite to those in the drawing or in lateral direction, depending on the working posture. In this case also, the angle between the ground contact point of the traveling body 4 and the ground is called the jack-up angle α. Typically, the traveling body 4 is long in the traveling direction and has a small lateral width orthogonal to the traveling direction. Therefore, if the boom 20 is lowered at a constant operating speed without changing the posture of arm 21, the jack-up speed will become faster when the traveling body 4 is in the lateral direction relative to the slewing body 3 than when the traveling body 4 is in the traveling direction relative to the swing body 3, because the distance between the point where the traveling body 4 comes in contact with the ground and the bucket 22 is smaller in the former case.

Target Jack-up Speed

Figure 5:
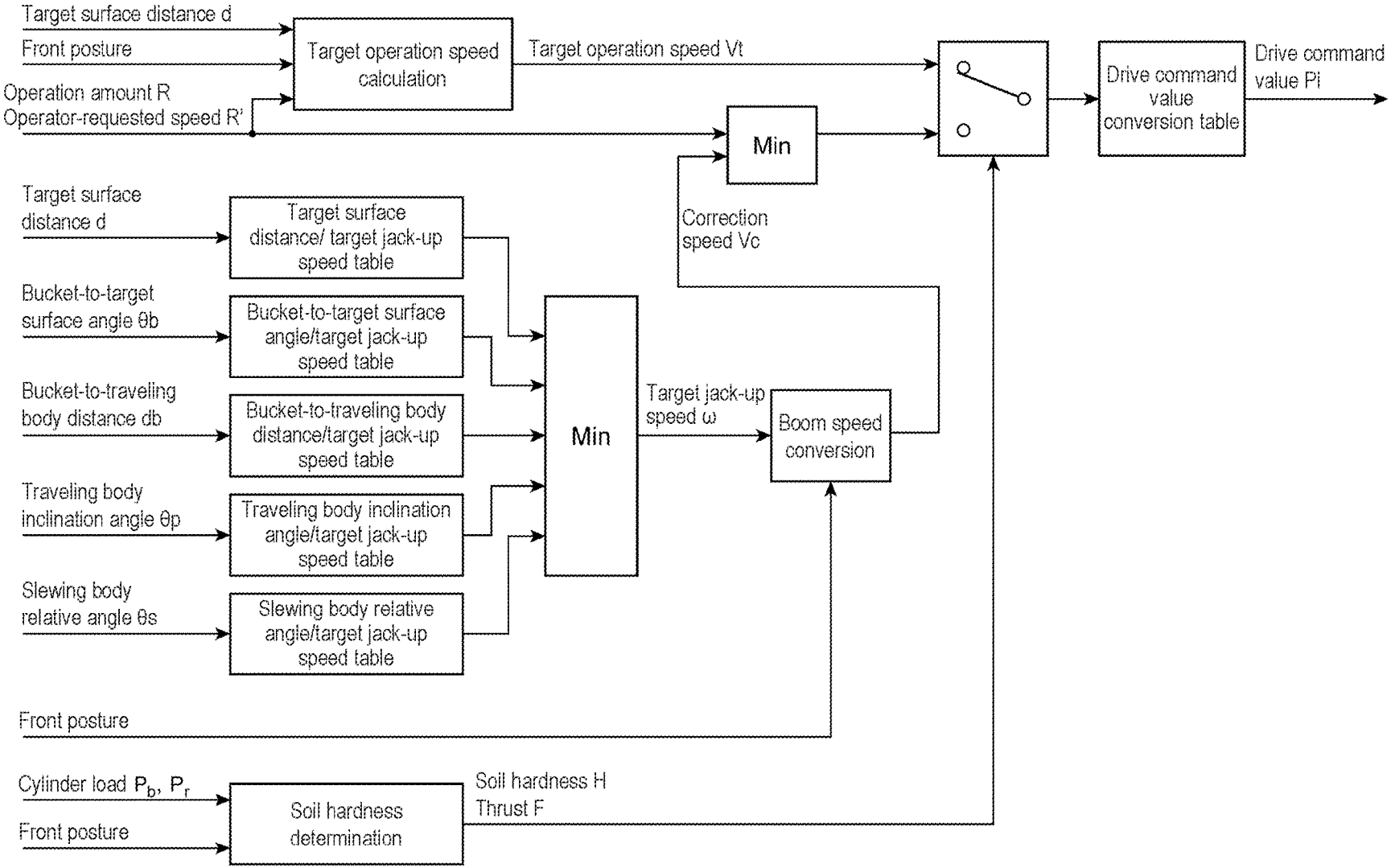
FIG. 5 shows control logic for the drive controller of the hydraulic excavator.

Referring to FIGS. 5 to 13, the following describes a method of determining the target jack-up speed. As shown in FIG. 5, the target jack-up speed ω is determined by selecting the minimum value in a target jack-up speed table, which is determined based on the target surface distance d, bucket-to-target surface angle θb, bucket-to-traveling body distance db, traveling body inclination angle θp, and stewing body relative angle θs. The speed when the hydraulic excavator 1 jacks up differs depending on the posture of the working front 2. The speed of the boom cylinder 20A, for example, is therefore calculated according to the posture of the working front 2 so as to reach the target jack-up speed. The calculation method is a simple geometric operation, and the detailed description thereof will be omitted.

As shown in FIG. 5, for the calculated target operating speed of the boom cylinder 20A, the minimum value is selected so as not to exceed the speed R' requested by the operator, and is output as the correction speed Vc. For example, when the soil hardness determination unit 910 determines that the soil is hard, the correction speed Vc is selected instead of the target operation speed Vt calculated by the target operation speed calculation unit 710, and a drive command value Pi is calculated based on a drive command value conversion table.

Figure 6:
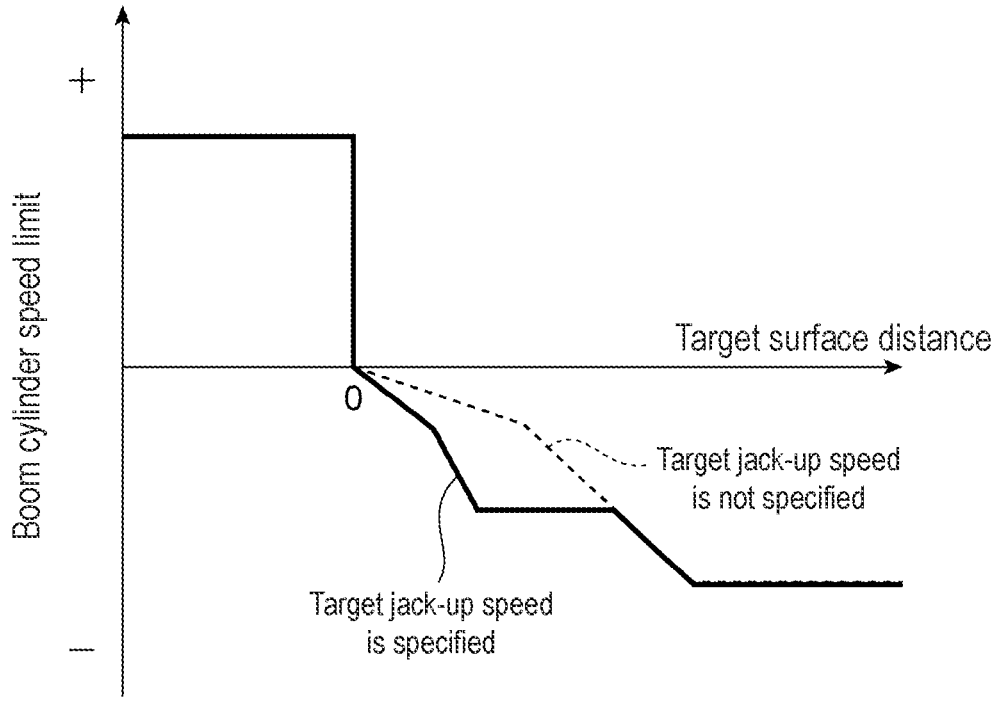
FIG. 6 shows the relationship between the boom cylinder speed limit and the target surface distance.

When the bucket 22 is brought closer to the construction target surface in normal machine control, the speed limit of the boom cylinder 20A with respect to the target surface distance d is as shown by the dotted line in FIG. 6 (i.e., this is an example of the case where the target jack-up speed is not specified). In contrast, when the control of the present embodiment is performed, the speed limit is as shown in the solid line in FIG. 6 (i.e., this is an example of the case where the target jack-up speed is specified). As can be seen from FIG. 6, in the example where the target jack-up speed is not specified, the slope of the dotted line is relatively gentle, so that the speed limit of the boom cylinder 20A is not relaxed and the boom lowering operation is relatively slow. In contrast, in the example where the target jack-up speed is specified, the slope rate of the solid line is relatively steep, and the speed limit of the boom cylinder 20A becomes large in a short time. Therefore, the speed limit of the boom cylinder 20A for the target construction surface that is close is relaxed to allow quick boom lowering operation, so that the hydraulic excavator 1 is able to be jacked up in a short period of time.

FIGS. 7 through 11 show examples of tables for determining the target jack-up speed ω based on the target surface distance d, bucket-to-target surface angle θb, bucket-to-traveling body distance db, traveling body inclination angle θp, and slewing body relative angle θs, respectively. The values in these tables are expressed as linear functions for convenience of explanation, but they may be quadratic functions and others. Their formats and values may be determined based on experimental values and design concepts.

Figure 7:
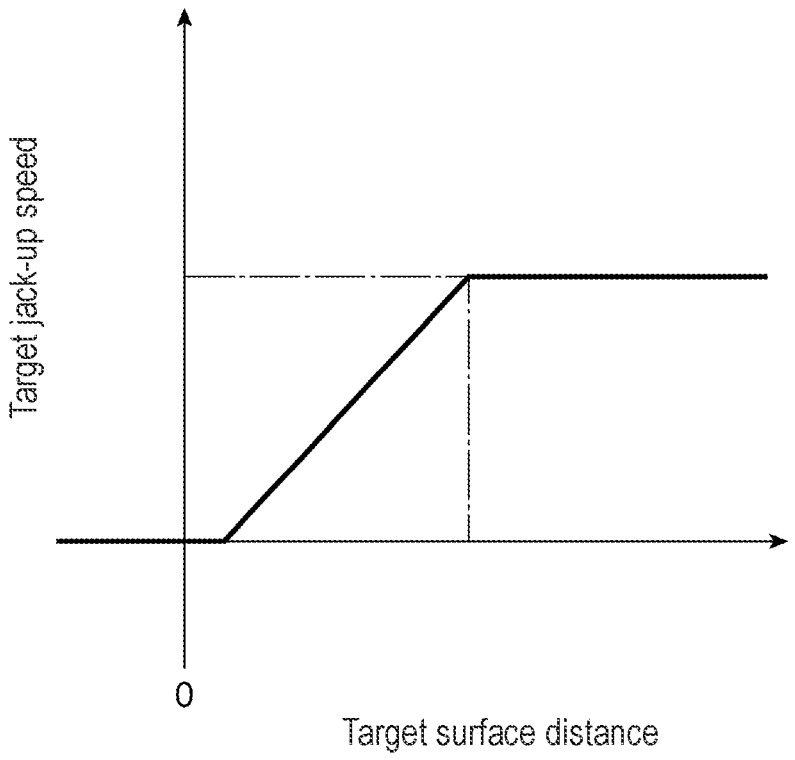
FIG. 7 shows a table: for determining the target jack-up speed based on the target surface distance.

In the present embodiment, preferably the target jack-up speed determination unit 920 determines the target jack-up speed co to be smaller as the target surface distanced is smaller (see FIG. 7). In this way, when the target jack-up speed ω is determined to be smaller as the target surface distance d is smaller, the bucket 22 will move slowly toward the construction target surface (e.g., at a limited speed so as not to excavate too much of the construction target surface), thereby preventing over-excavating of the construction target surface.

Figure 8:
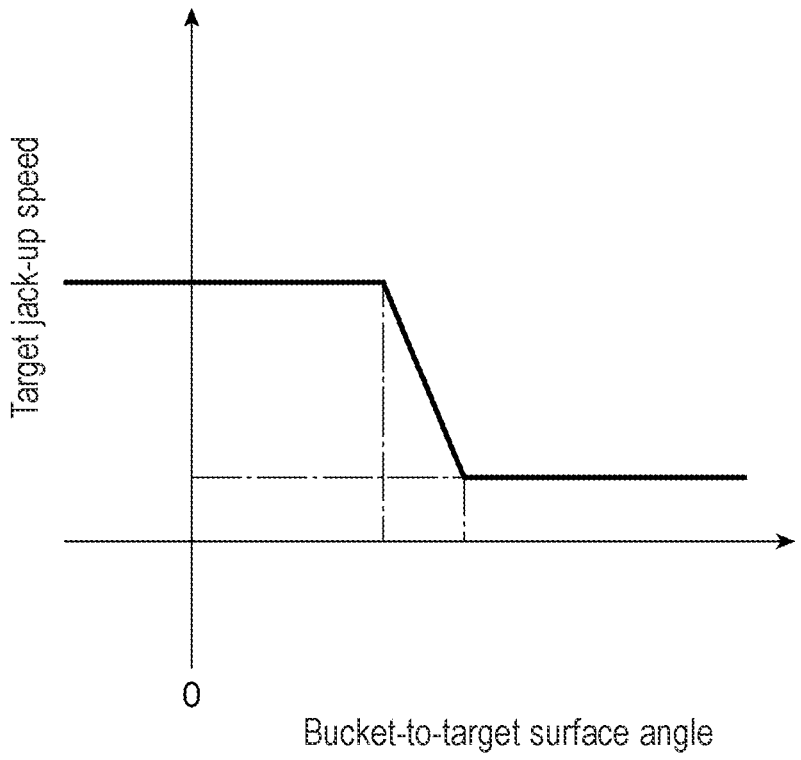
FIG. 8 shows a table for determining the target jack-up speed based on the bucket-to-target surface angle.

Preferably, the target jack-up speed determination unit 920 determines the target jack-up speed ω to be larger as the bucket-to-target surface angle θb is smaller (see FIG. 8). When the bucket-to-target surface angle θb is small, the construction target surface is not over-excavated. Therefore, a larger target jack-up speed ω may be determined for quick jack-up.

Figure 9:
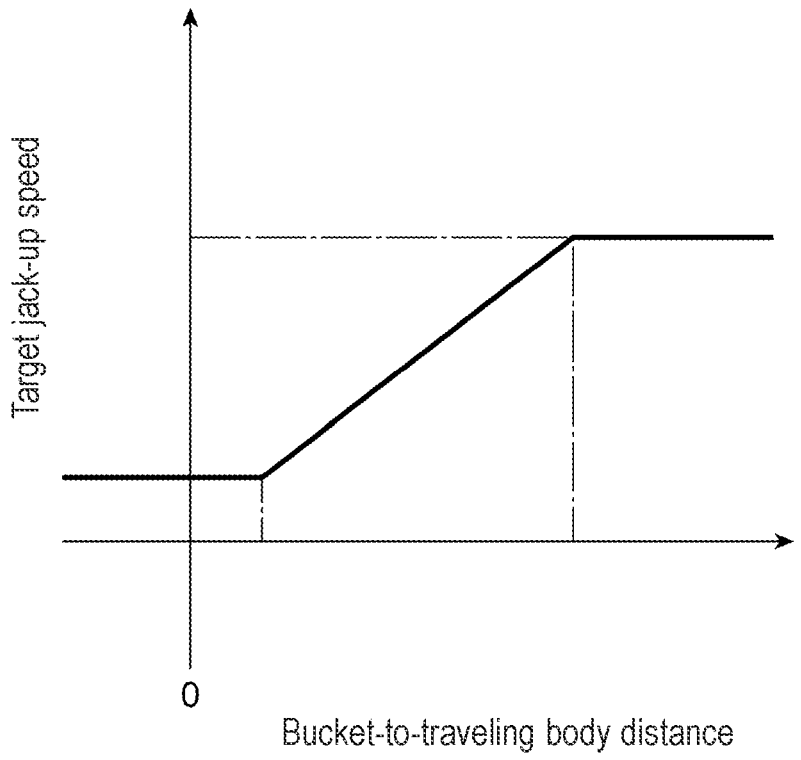
FIG. 9 shows a table for determining the target jack-up speed based on the bucket-to-traveling body distance.

Preferably, the target jack-up speed determination unit 920 determines the target jack-up speed co to be larger as the bucket-to-traveling body distance db is larger (see FIG. 9). When the bucket-to-traveling body distance db is large, it is at the beginning of excavating, and a larger target jack-up speed ω may be determined for quick jack-up. In other words, when the target surface distance d is small, this means that the excavating is about to end. Thus there is no need for quick jacking up. Moreover, when the bucket is nearby, the excavation force of the bucket 22 increases due to the weight balance at the same jack-up speed, increasing the likelihood of over-excavating of the construction target surface. From the viewpoint of preventing such over-excavating, the target jack-up speed ω has to be determined small when the bucket-to-traveling body distance db is small.

Figure 10:
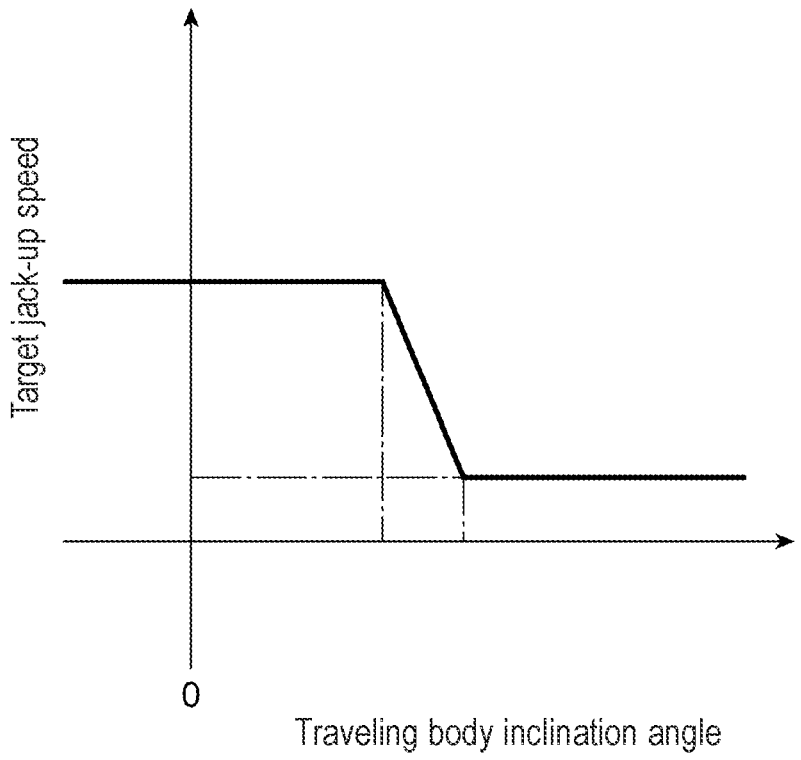
FIG. 10 shows a table for determining the target jack-up speed based on the traveling body inclination angle.

Preferably, the target jack-up speed determination unit 920 determines the target jack-up speed ω to be smaller as the traveling body inclination angle θp is larger (see FIG. 10). When the traveling body inclination angle θp is large, the hydraulic excavator 1 tends to become unstable, and quick jack-up tends to give the operator a sense of uneasiness. Therefore, the present embodiment makes jack-up slow to ensure good operability.

Figure 11:
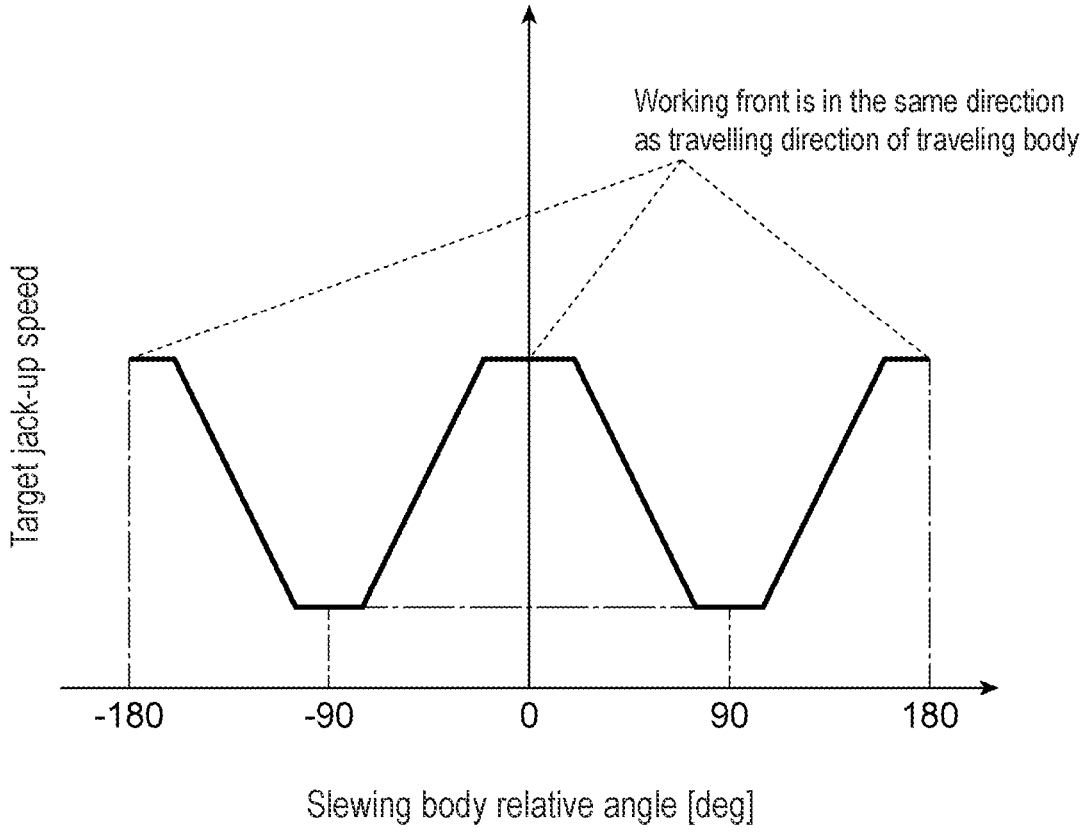
FIG. 11 shows a table for determining the target jack-up speed based on the clewing body relative angle.

Preferably, the target jack-up speed determination unit 920 determines the target jack-up speed ω to be smaller as the slewing body relative angle θs is larger (see FIG. 11). When the slewing body relative angle θs is large, the working front 2 laterally faces the traveling body 4. The hydraulic excavator 1 therefore tends to become unstable, and quick jack-up tends to give the operator a sense of uneasiness. Therefore, the present embodiment makes jack-up slow to ensure good operability.

Figure 12A:
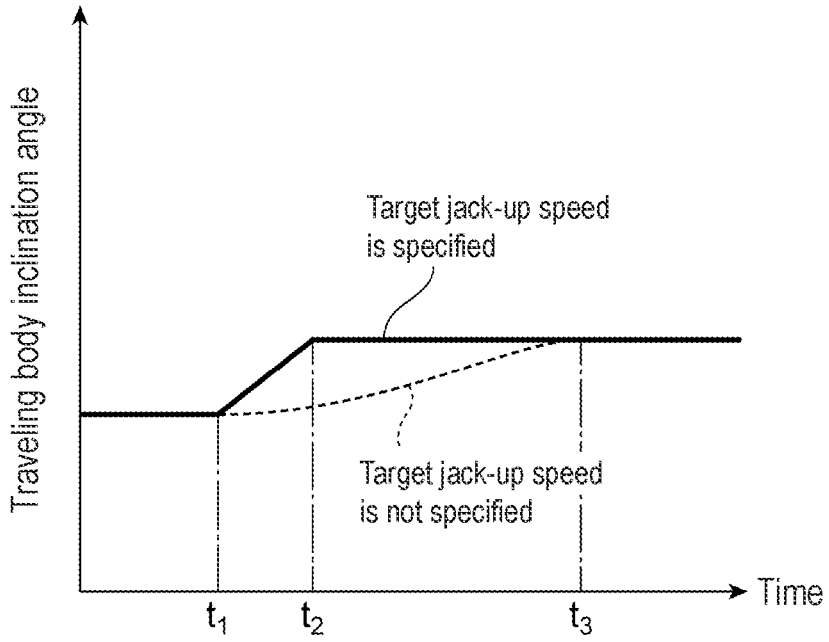
FIG. 12A shows a change of the traveling body inclination angle over time when an excavation operation is performed.

FIG. 12A shows an example of the change of the traveling body inclination angle θp over time. In this drawing, the solid line indicates the case where the target jack-up speed ω is specified and the dotted line indicates the case where the target jack-up speed ω is not specified. As shown in 12A, when the target jack-up speed ω is specified, jack-up of the hydraulic excavator 1 is completed by time $t_2$, where the start time is $t_1$. In contrast, when the target jack-up speed ω is not specified, the jack-up is completed at time $t_3$, which is later than time $t_2$. In this way, when the target jack-up speed ω is specified, the change of the traveling body inclination angle θp over time is rapid, and the jack-up operation can be performed in a shorter time than when the target jack-up speed ω is not specified.

Figure 12B:
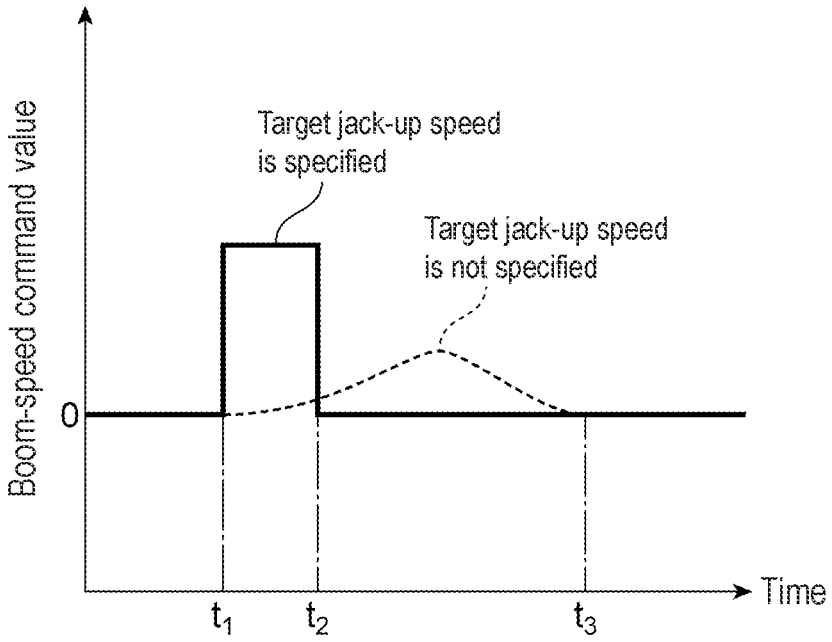
FIG. 12B shows a change of the boom-speed command value over time when an excavation operation is performed.
Figure 13:
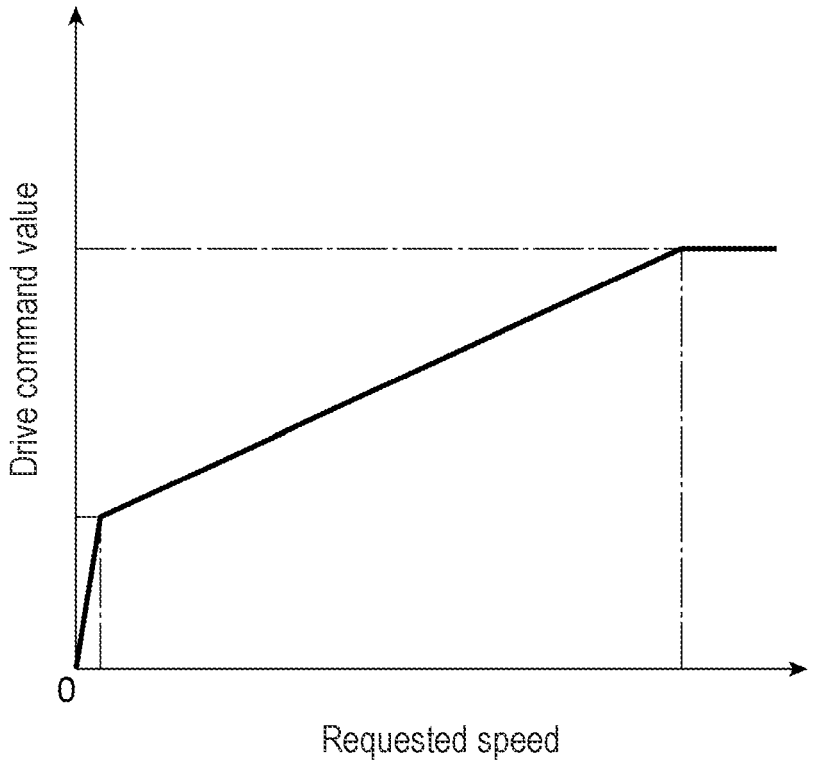
FIG. 13 shows a table for determining the drive command value based on the requested speed.

FIG. 12B shows an example of the change of the boom-speed command value over time. In this drawing, the solid line indicates the case where the target jack-up speed ω is specified and the dotted line indicates the case where the target jack-up speed ω is not specified. As shown in FIG. 12B, when the target jack-up speed ω is specified, the boom-speed command value suddenly increases immediately after the time $t_1$ ($t_1$ denotes the start time), and the boom speed command value becomes zero at time $t_2$ when jack-up of the hydraulic excavator 1 is completed. In contrast, when the target jack-up speed ω is not specified, the boom speed command value gradually increases from time $t_1$, and the boom speed command value reaches zero at time $t_3$ when the jack-up of the hydraulic excavator 1 is completed. In this way, the boom speed command value increases more suddenly when the target jack-up speed ω is specified than when the target jack-up speed ω is not specified. Therefore the former case allows jack-up operation in a shorter time. FIG. 13 shows an example of a table to convert requested speed (e.g., correction speed Vc) to drive command values to drive the boom. In this case, the motion command value generation unit 720 refers to the conversion table shown in FIG. 13 to generate a drive command value Pi based on the correction speed Vc.

The target operation speed correction unit 930 calculates the correction speed Vc for the boom cylinder 20A based on the front posture and the operation amount R by the operator so as to achieve the target jack-up speed ω of the traveling body 4 determined by the target jack-up speed determination unit 920. For a calculation method of the correction speed Vc, a well-known method can be used. The target operation speed correction unit 930 also outputs the calculated result to the motion command value generation unit 720.

Figure 14:
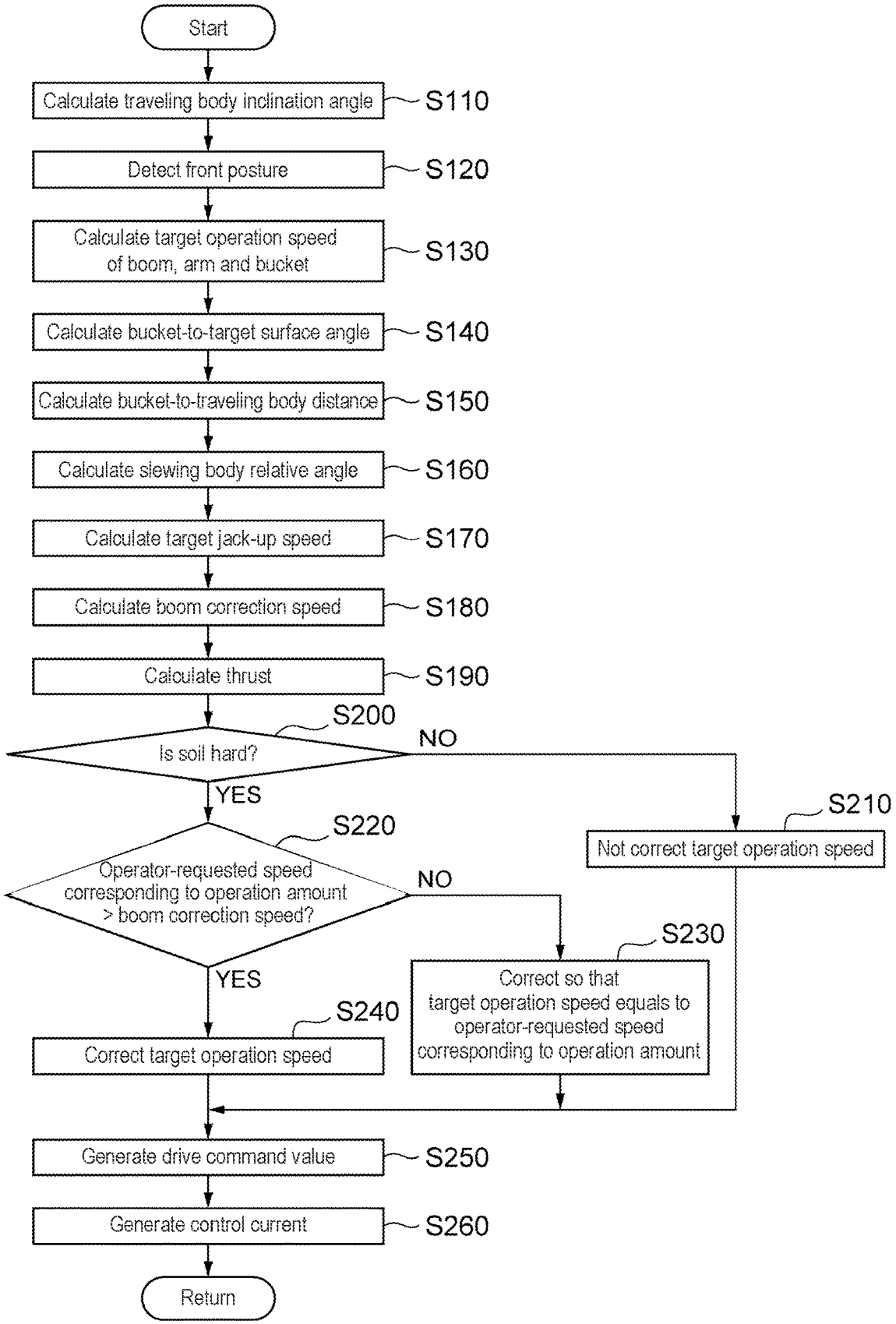
FIG. 14 is a flowchart showing the control process by the drive controller.

Referring to FIG. 14, the following describes the control process by the drive controller 34. First, in step S110, the traveling body inclination angle θp is calculated. In this step, the inclination angle calculation unit 820 calculates the inclination angle of the slewing body 3 based on the acceleration signal and the angular velocity signal obtained from the slewing body IMU sensor 30S attached to the slewing body 3, where the calculated inclination angle of the slewing body 3 is the traveling body inclination angle θp.

In step S120 following step S110, the front posture is detected. At this time, the front posture detector 830 detects the posture of the boom 20, arm 21, and bucket 22 of the working front 2 based on the acceleration signal and the angular velocity signal obtained from the boom IMU sensor 20S, the arm IMU sensor 21S, and the bucket IMU sensor 22S, respectively. This detects the front posture.

In step S130 following step S120, the target operation speed Vt of the boom 20, arm 21, and bucket 22 is calculated. In this step, the target operation speed calculation unit 710 calculates the target operation speed Vt of at least one of the boom cylinder 20A, arm cylinder 21A, and bucket cylinder 22A so that the bucket 22 moves along the construction target surface, based on the front posture detected in step S120, the operation amount R of the operation levers 33A and 33B detected by the operation input amount sensor 33C, and the target surface distance d calculated by the target surface management unit 100. For example, the target operation speed calculation unit 710 calculates the target operation speed Vt of the boom cylinder 20A based on the front posture, the target surface distance d, and the operation amount R of the operation levers 33A and 33B so as not to excavate too much beyond the construction target surface.

In step S140 following step S130, the bucket-to-target surface angle θb is calculated. In this step, the target surface management unit 100 calculates the angle between the bottom surface of the bucket 22 and the construction target surface.

In step S150 following step S140, the bucket-to-traveling body distance db is calculated. In this step, the target jack-up speed determination unit 920 calculates the bucket-to-traveling body distance db based on the posture of the working front detected in step S120.

In step S160 following step S150, the stewing body relative angle θs is calculated. In this step, the slewing angle calculation unit 840 calculates the stewing body relative angle θs based on the signal detected by the slewing angle sensor 37.

In step S170 following step S160, the target jack-up speed ω is calculated. In this step, the target jack-up speed determination unit 920 uses the target surface distance d in addition to the traveling body inclination angle θp calculated in step S110, the bucket-to-target surface angle θb calculated in step S140, the bucket-to-traveling body distance db calculated in step S150, and the slewing body relative angle θs calculated in step S160 to calculate and determine the target jack-up speed ω for jacking-up the traveling body 4 based on these.

In step S180 following step S170, the correction speed of the boom is calculated. In this step, the target operation speed correction unit 930 calculates the correction speed Vc of the boom cylinder 20A based on the front posture and the operator's operation amount R so as to achieve the target jack-up speed ω calculated in step S170.

In step S190 following step S180, the soil hardness determination unit 910 calculates the thrust F of the boom cylinder 20A based on the above equation (1).

In step S200 following step S190, the soil hardness determination unit 910 compares the calculated thrust of the boom cylinder 20A with a predetermined threshold to determine whether or not the soil is hard. If the calculated thrust of the boom cylinder 20A is less than or equal to the threshold, it is determined that the soil is not hard. Then, the drive controller 34 does not correct the target operation speed (see step S210). In step S210, the drive controller 34 directly uses the target operation speed Vt of the boom cylinder 20A calculated in step S130, for example. After step S210, the control process proceeds to step S250, where the motion command value generation unit 720 generates a drive command value Pi based on the target motion speed Vt.

If the thrust is determined to be greater than the threshold in step S200, the soil is determined hard, and the control process proceeds to step S220.

In step S220, the drive controller 34 determines whether or not the operator requested speed R' corresponding to the operation amount R of the operation levers 33A and 33B is larger than the correction speed Vc of the boom cylinder 20A calculated in step S180. The operator requested speed R' corresponding to the operation amount R is calculated by the target operation speed calculation unit 710. If it is determined that the operator requested speed R' corresponding to the operation amount R is not greater than the correction speed Vc of the boom cylinder 20A, the drive controller 34 corrects the target operation speed so that the target operation speed becomes equal to the operator requested speed R' corresponding to the operation amount R (see step S230). After step S230, the control process proceeds to step S250, where the motion command value generation unit 720 generates a drive command value Pi based on the corrected target motion speed (i.e., operator requested speed corresponding to the operation amount R).

If it is determined in step S220 that the operator requested speed R' corresponding to the operation amount R is greater than the correction speed Vc of the boom cylinder 20A calculated in step S180, the drive controller 34 corrects target operation speed without limiting the target operation speed (see step S240). In this step, the drive controller 34 corrects the target operation speed so that the correction speed Vc of the boom cylinder 20A calculated in step S180 is the target operation speed of the boom cylinder 20A. In step S250 following step S240, a drive command value is generated. In this step, the motion command value generation unit 720 generates a drive command value Pi based on the corrected target operation speed (i.e., the correction speed Vc of the boom cylinder 20A calculated in step S180).

In step S260 following step S250, control current is generated. In this step, the drive command unit 730 generates control current I required for driving the electromagnetic control valve 35A based on the drive command value Pi generated in step S250. This completes the series of control process.

In the hydraulic excavator 1 of this embodiment, the target jack-up speed determination unit 920 calculates and determines the target jack-up speed ω for jacking-up of the traveling body 4, based on the target surface distance d, bucket-to-target surface angle θb, bucket-to-traveling body distance db, traveling body inclination angle θp, and clewing body relative angle θs, and the target operation speed correction unit 930 calculates the correction speed Vc of the boom cylinder 20A to achieve the target jack-up speed ω of the traveling body 4. When excavating hard soil that requires jacking up, this configuration corrects the target operation speed regardless of the limit value of the boom operation speed near the construction target surface. In this way, this configuration sets any speed for jacking-up the hydraulic excavator, thus enabling quick jack-up near the target construction surface. When excavating soft soil that does not require jacking up, this configuration sets the speed of jacking-up the hydraulic excavator 1 at zero, that is, limits the correction of the operation speed of the boom cylinder 20A for jacking up. This prevents over-excavation of the construction target surface.

Further, if the soil hardness determination unit 910 determines that the soil is hard, the motion command value generation unit 720 generates a drive command value based on the target motion speed (i.e., correction speed Vc) corrected by the target motion speed correction unit 930.

Furthermore, the target operation speed correction unit 930 corrects the target operation speed so that the correction speed calculated based on the target jack-up speed ω does not exceed the operator requested speed R' corresponding to the operation amount R calculated by the target operation speed calculation unit 710. If jack-up is performed faster than the operator requested speed R' corresponding to the operation amount R of the operation lever by the operator, the operator tends to feel uneasy. This embodiment therefore performs jack-up so as not to exceed the operator requested speed R' corresponding to the operation amount R, thus further enhancing the operability. As a result, this embodiment achieves quick jack-up near the target construction surface, and enhances excavation accuracy as well as the operability and workability for the operator.

That is a detailed description of the embodiments of the present invention. The present invention is not limited to the above-stated embodiments, and the design may be modified variously without departing from the spirits of the present invention.

REFERENCE SIGNS LIST

1 Hydraulic excavator
2 Working front
3 Stewing body
4 Traveling body
20 Boom
20BP Boom bottom pressure sensor
20RP Boom rod pressure sensor
20S Boom IMU sensor
21 Arm
21S Arm IMU sensor
22 Bucket
22S Bucket IMU sensor
30S Stewing body IMU sensor
33 Operation amount detector
33A, 33B Operation lever (operation device)
33C Operation input amount sensor
34 Drive controller
35 Drive unit
35A Electromagnetic control valve
37 Stewing angle sensor
38 Posture detector
39 Load detector
100 Target surface management unit
710 Target operation speed calculation unit
720 Motion command value generation unit
730 Drive command unit
810 Cylinder load calculation unit
820 Inclination angle calculation unit
830 Front posture detector
840 Stewing angle calculation unit
910 Soil hardness determination unit
920 Target jack-up speed determination unit
930 Target operation speed correction unit

The invention claimed is:

1. A hydraulic excavator comprising: a traveling body that travels;

a stewing body mounted to the traveling body to be slewable;

a working front mounted to the slewing body to be swingable, the working front having a boom, an arm, and a bucket;

an actuator configured to drive the boom, the arm, and the bucket;

an operation amount detector configured to detect an operation amount of an operation device to operate the actuator;

a posture detector configured to detect a posture of the working front and a posture of the slewing body;

a target surface management unit configured to set a construction target surface and calculate a target surface distance that is a distance between the set construction target surface and the bucket;

a drive controller configured to calculate a target operation speed of the actuator based on the operation amount, the posture of the working front, and the target surface distance so that the bucket excavates along the construction target surface, and generate a motion command value to the actuator; and a drive unit configured to drive the actuator in accordance with the motion command value, wherein:

the drive controller is configured to determine a target jack-up speed when the hydraulic excavator jacks up the hydraulic excavator based on the target surface distance, and correct the target operation speed based on the determined target jack-up speed.

2. The hydraulic excavator according to claim 1, further comprising a load detector configured to detect a load of the actuator, wherein the drive controller is configured to determine a soil hardness of a place to be excavated by the working front based on a result detected by the load detector, correct the target operation speed based on the soil hardness and a correction speed calculated based on the target jack-up speed, and generate the motion command value based on the corrected target operation speed.

3. The hydraulic excavator according to claim 1, wherein the drive controller is configured to determine the target jack-up speed to be smaller as the target surface distance is smaller.

4. The hydraulic excavator according to claim 1, wherein the target surface management unit is configured to calculate a bucket-to-target surface angle that is an angle between a bottom surface of the bucket and the construction target surface, and the drive controller is configured to determine the target jack-up speed to be larger as the bucket-to-target surface angle is smaller.

5. The hydraulic excavator according to claim 1, wherein the drive controller is configured to calculate a bucket-to-traveling body distance that is a distance between the bucket and the traveling body in accordance with the posture of the working front, and the drive controller is configured to determine the target jack-up speed to be larger as the calculated bucket-to-traveling body distance is larger.

6. The hydraulic excavator according to claim 1, wherein the drive controller is configured to calculate a traveling body inclination angle based on a result detected by the posture detector, and the drive controller is configured to determine the target jack-up speed to be smaller as the calculated traveling body inclination angle is larger.

7. The hydraulic excavator according to claim 1, wherein the drive controller is configured to calculate a slewing body relative angle that is a relative angle between the stewing body and the traveling body based on a traveling direction of the traveling body in accordance with a result detected by the posture detector, and the drive controller is configured to determine the target jack-up speed to be smaller as the calculated slewing body relative angle is larger.

8. The hydraulic excavator according to claim 2, wherein the drive controller is configured to correct the target operation speed so that the correction speed does not exceed operator-requested speed corresponding to the operation amount.

* * * * *